United States Patent [19]

Rodenberg et al.

[11] Patent Number: 4,967,236

[45] Date of Patent: Oct. 30, 1990

[54] CHARGE RETENTION XEROPRINTING

[75] Inventors: Orville C. Rodenberg; William Mey; Francis M. Paczkowski; Salvatore Leone, all of Rochester, N.Y.

[73] Assignee: Eastman Kodak Company, Rochester, N.Y.

[21] Appl. No.: 457,614

[22] Filed: Dec. 27, 1989

[51] Int. Cl.[5] ..... G03G 15/14

[52] U.S. Cl. ..... 355/272; 355/77; 430/54

[58] Field of Search ..... 385/272, 271, 217, 242, 385/244, 77; 430/54, 126

[56] References Cited

U.S. PATENT DOCUMENTS 4,407,918 10/1983 Sato ..... 430/54

*Primary Examiner*—R. L. Moses

*Attorney, Agent, or Firm*—Leonard W. Treash, Jr.

[57] ABSTRACT

Xeroprinting is performed without fusing a master toner image. A master toner image is made by conventional electrophotography, for example, by charging, imagewise exposing and applying toner to a photoconductive imaging member to create a first toner image. The first toner image is charged with charges of a first polarity opposite that of the toner image and the member is erased with erase illumination through its base. This creates a toner image with a charge opposite that of the original toner image which is tightly held by opposite charges which have migrated to the portion of the electrophotosensitive member just under the toner. The imaging member is then toned again with toner of the same polarity as the original toner to create a second toner image that overlies the first toner image. The imaging member is again erased through its base, and the second toner image is transferred to a receiving sheet without disturbing the first toner image. The toner image may then be used as a master to repeat the process but without the necessity of creating the master toner image again.

15 Claims, 2 Drawing Sheets

CHARGE RETENTION XEROPRINTING

TECHNICAL FIELD

This invention relates to xeroprinting and more specifically to xeroprinting in which the master is both formed and used in the same process.

BACKGROUND ART

Traditional xeroprinting, for example, as disclosed in Schaffert, ELECTROPHOTOGRAPHY, p. 209, Vol. 2, 1975, usually involves electrostatic creation of a toner image, transfer of the toner image to a conductive support and fusing of the toner image to the support to make a xeroprinting master. The master can be repeatedly charged and toned and the toner image transferred to create a large number of duplicates of the master. See also U.S. Pat. Nos. 4,129,072; 4,273,438; 4,286,031; 4,443,093.

U.S. Pat. Nos. 4,338,386; 4,471,694; and 4,286,031 describe similar processes but suggest cleaning the fixed toner image off the substrate after use so that the substrate can be reused. For example, it can be cleaned off by solvent or by scraping.

Reuse of the substrate is desirable because it permits the use of a permanent master substrate in the form of drums and endless webs in xeroprinting apparatus, eliminating the need for separately forming masters and hand mounting them in the xeroprinting apparatus. However, the use of solvents, scraping and the like to clean a fused image off the substrate is impractical. At the very least, it greatly limits the materials that can be used.

A number of processes suggest methods of obtaining a number of images out of a single exposure without actually fusing a toner image as in the art cited above. See for example, U.S. Pat. Nos. 4,297,422 and 4,298,032 which are representative examples only. Unfortunately, each of these processes have specific problems of their own. For example, U.S. Pat. No. 4,297,422 includes a step of uniform exposure through a transfer substrate which restricts the process to use with at least translucent receiving sheets or some sort of translucent intermediate.

DISCLOSURE OF THE INVENTION

The object of this invention is to provide a xeroprinting process in which a toner image forming a xeroprinting master is not fused and, therefore, the substrate is reusable without many of the attending problems associated with similar prior art.

These and other objects are accomplished by a xeroprinting method and apparatus in which an electrostatic image of a first or second polarity is formed on a photoconductive imaging member. Toner of the second polarity is applied to the member to create an unfused first toner image defined by the electrostatic image. That image is not fused. Instead, the imaging member is charged with a substantial charge of the first polarity opposite the second polarity. The imaging member is illuminated from the rear to erase charge in the untoned areas and to create a charge of the first polarity on the first toner image which is held tight to the imaging member by charges of a second polarity which have migrated to the vicinity of the surface holding the toner. This process of recharging and erase can be repeated several times to intensify the charge of the first polarity and its complementary holding charge on the first toner image. Toner of the second polarity (which can be the same toner as previously used) is then applied to the surface and is attracted preferentially to the charge of the first polarity on the first toner image to create a second toner image overlying the first toner image. The rear erase step is repeated. The second toner image is then transferred electrostatically to a receiving sheet. The last portion of the process may then be repeated to reuse the first toner image to make more prints. When the desired number of prints have been made, the first toner image may be cleaned and the imaging member reused.

Since the first toner image is never fused in the process, cleaning and reuse can be done by ordinary loose toner cleaning devices.

What surprised the experts in this process is that the recharge and rear erase steps, prior to the second development step, appear to hold the first toner image sufficiently tightly to the substrate so that it does not transfer (or very little of it transfers) with the second toner image. What mechanism causes this surprising result is not entirely clear. However, it is believed that the positive charges which migrate to the vicinity of the surface of the substrate in the rear erase steps cooperate with the negative charges on the surface of the toner to hold it in place.

DISCLOSURE OF THE PREFERRED EMBODIMENT

Figure 1A:
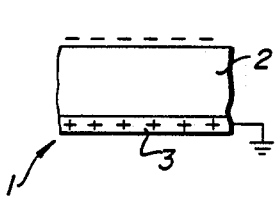
FIG. 1 illustrates the invention in process steps (a) to (h).
Figure 1B:
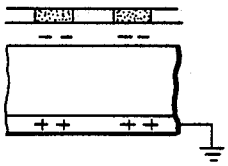
Figure 1C:
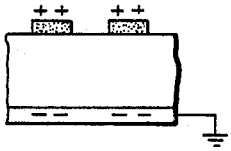
Figure 1D:
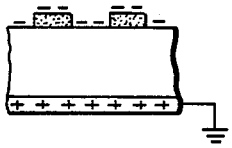
Figure 1E:
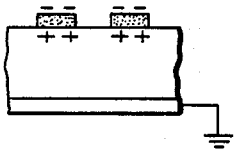
Figure 1F:
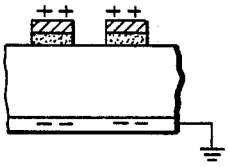
Figure 1G:
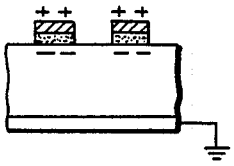
Figure 1H:
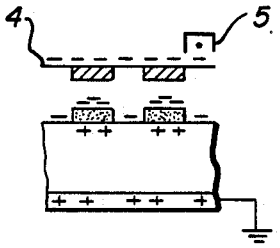

According to FIG. 1, a transparent photoconductive imaging member 1 includes a photoconductive layer 2 and a conductive layer 3, both of which are transparent. As is well known in electrophotography, many other layers, including barrier layers, can also be used.

At step (a) the imaging member 1 is uniformly charged to a charge of a first polarity, for example, negative. At step (b) the imaging member 1 is exposed to imagewise radiation to create an electrostatic image, and at step (c) that electrostatic image is toned by the application of toner of a second polarity, which second polarity is opposite the first polarity, to create a first toner image initially of the second polarity.

Thus far the process has followed conventional electrophotography. In step (d), as heavy a charge as the imaging member will accept of the first polarity is applied to create substantial charge on both the toner and the surrounding background portions of the imaging member. In step (e) the imaging member 1 is flooded with an erase light, preferably from the rear, comprising activating radiation which mobilizes the charges in the photoconductive member 2. The result of this step is a dissipation of charge in the untoned area. However, the negative charges on the first toner images have not dissipated, since the toner is insulating. Positive charges have migrated from the conductive layer 3 to the vicinity of the surface of the imaging member underneath the toner. The steps of recharging (d) and erasing (e) can be repeated to obtain a higher concentration of negative charge and complementary positive charge on the toner and the surface of the imaging member, as shown in (e).

In step (f) toner of a second polarity (which can be the same as the toner making up the first toner image) is applied to imaging member 1 to create a second toner image overlying the first toner image. That is, toner of the second polarity adheres to the charges of the first polarity on the surface of the first toner image.

At step (g) the imaging element is again erased with activating illumination, preferably from the rear. At step (h) the second toner image is electrostatically transferred to a receiving sheet 4 using an electric field, for example, a field created by a corona charger 5 biased to a charge of the first polarity on the reverse side of the receiving sheet 4.

Remarkably, nearly all of the second image transfers and nearly all of the first image stays with the imaging member. Thus, the last portion of the process can be repeated to give further transferred images. In repeating the process, we first returned to step (d) and repeated the recharging, rear erase steps before the second development step (f). However, we later found that there was sufficient negative charge remaining on the first toner image after transfer to eliminate the recharging step (d). In fact, marginally acceptable images were obtained without the rear erase step (e) as well. However, for best results that step is repeated each time, since some negative charge appears to form in the background areas of the image as a result of the transfer step. Note that an appropriate bias at the second development stage can prevent toner from adhering to those background areas. However, much higher contrast can be obtained if the rear erase step is repeated.

Figure 2:
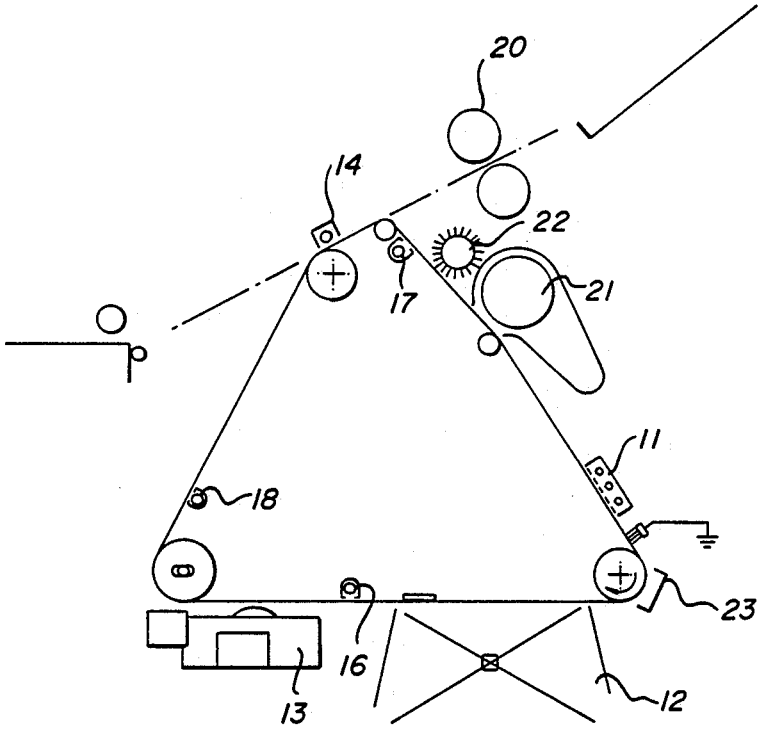
FIG. 2 is a side schematic of an apparatus for carrying out the invention.

FIG. 2 shows an apparatus for carrying out the process described with respect to FIG. 1 and includes some elements designed to carry out variations in the process to be described below. According to FIG. 2 a photoconductive imaging member 10 constructed substantially the same as the imaging member in FIG. 1 is formed as an endless web and is trained about a series of rollers. One of the rollers drives the web through an endless path past a series of electrophotographic stations, including stations which carry out all the steps shown in FIG. 1. A primary charger 11 applies a negative uniform electrostatic charge on imaging member 10. The uniformly charged imaging member 10 is imagewise exposed at an exposure station 12 to create a negative electrostatic image, which negative electrostatic image is toned at a development station to create a first positive toner image corresponding to the electrostatic image on the imaging member 10. The imaging member with the first positive toner image is negatively charged by either a transfer charger 14 or the primary charger 11. The image is exposed by an auxiliary erase lamp 16 and developed a second time at development station 13. The image is again exposed to rear erase illumination at an erase lamp 18, and the second toner image is transferred by transfer charger 14 to a receiving sheet fed into contact with imaging member 10 as in conventional electrophotography. The receiving sheet separates from imaging member 10 as imaging member 10 changes direction around a roller and is transported to a fuser 20, again as in conventional electrophotography.

Subsequent prints are made using erase lamp 16, development station 13, erase lamp 18 and transfer station 14 to continually form second toner images and transfer them to new receiving sheets.

EXAMPLE 1

The process was carried out with the equipment shown in FIG. 2 using as a development station a magnetic brush development station formed substantially as shown in U.S. Pat. No. 4,473,029 to Fritz et al, in which hard magnetic carrier particles and insulating toner particles are transported around a moving shell using a rapidly rotating magnetic core. Development stations of this type are particularly soft. In this example, the toner was a crosslinked styrene-acrylic resin with particle sizes of approximately 12 microns and a resistivity of of approximately $10^{16}$ ohm/cm. The carrier was a coated ferrite carrier with high coercivity and a resistivity of $10^{12}$ ohm/cm. This development process is thoroughly described in the Fritz et al patent. Reference is made to this patent for more details. The photoconductive imaging member was a commercial aggregated composite photoconductor film.

A large number of runs were made with this apparatus and these materials, and typically 20 to 30 good quality prints were made using the above-described procedure before image degradation caused copy quality to become unacceptable. After the desired number of prints were made, the master image, that is, the first toner image, was cleaned off at a vacuum brush cleaner 21 and the image member was reused successfully.

EXAMPLE 2

Prints were made substantially as in Example 1 except that a magnetic brush cleaning station 22 was used to clean the image after transfer. That is, after the second toner image has been transferred at transfer station 14, the first toner image is run through a magnetic brush cleaning station 22 which does not remove the first toner image but apparently cleans it of residual toner from the second toner image still remaining after transfer. For this purpose, magnetic brush cleaning station 22 with a soft brush similar to that used in the development station is used. It includes a rotating magnetic core inside a shell with hard magnetic carrier particles and no toner. This brush is biased positively, and apparently cleans off small particles from the second toner image that have picked up a negative bias in the process and, therefore, did not transfer. Biases on the magnetic cleaning brush between 200 and 900 volts were used successfully. With this cleaning step, 200 high quality prints were made from a single frame.

EXAMPLE 3

In this example, after transfer of each second toner image, the imaging member 10 was recharged by primary charger 11 and was front erased, for example, by an electroluminescent panel 23. This appeared to increase the intensity of the negative charge on the toner which increased the coverage of the second toner image and increased density in solid areas in the prints.

EXAMPLE 4

In Examples 1 through 3 the same toner was used for both toner images. In Example 4 the conventional styrene-acrylic toner was used for the first toner image, and a low surface adhesion toner was used for the second toner image. The low surface adhesion toner was a conventional toner of styrene-acrylic toner particles which had a fluorinated charge agent to improve transfer. With this toner, a total of 100 good quality prints were made from a single master image using the Example 1 process and 50 good quality prints of higher density using the Example 3 process was made.

EXAMPLE 5

A photoconductor used in Examples 1 through 4 for the imaging member was replaced by a bipolar aggregated photoconductor capable of being charged and discharged after charging either positively or negatively. In this example, the primary charger was made positive, and after exposure, a positive toner was applied, resulting in toning of the discharged areas providing a negative image of the original, as in conventional negative-positive electrophotography. This first toner image was then recharged negatively followed by rear erase and multiple copies were made as described in Example 1. The results were equivalent to those of Example 1 demonstrating that the process can be used in negative-positive systems.

EXAMPLE 6

After approximately ten prints were made, as described in Example 1, the image member and toner image were recharged positively and the film was erased from the rear. A negative corona was used to transfer the first toner image to plain paper with good image quality. A similar result was obtained by recharging negatively and using a positive corona at the transfer station.

This demonstrates that an additional print can be made using the first toner image after the other prints have been made, thereby putting somewhat less toner back through the cleaning system in the course of reuse.

It is important that the second toning station not disturb the first toner image. The rotating magnetic core and hard magnetic carrier particle system used is one of a number of development systems that are "soft". Other systems that could be used are systems known as projection toning systems in which a toner is projected across a small air gap, generally in the presence of an alternating electric field. Low surface adhesion toners, in combination with such projection development, also provide excellent extension of the print run.

Although excellent results were obtained as described above, in some instances both longer runs and increased density could be obtained by repetition of the recharge and rear erase steps (d) and (e) several times before beginning the print cycle with the second toner image development. This can be accomplished in the FIG. 2 apparatus by passing the imaging member through a complete cycle several times or by utilizing both the primary charger and erase lamp 16 and the transfer charger and an erase lamp 17 on a single cycle.

In addition to the obvious use of this invention in high speed printing with optical input, other uses could be made including using the master to mass produce printed circuit boards and other similar applications.

The invention has been described in detail with particular reference to a preferred embodiment thereof, but it will be understood that variations and modifications can be effected within the spirit and scope of the invention as described hereinabove and as defined in the appended claims.

We claim:

1. A method of xeroprinting comprising:

(a) applying a charge to a photoconductive imaging member, (b) imagewise exposing said member to create an electrostatic image, (c) applying toner of a second polarity to said photoconductive member to create a first toner image defined by said electrostatic image, (d) applying a charge of a first polarity, opposite the second polarity, to said photoconductive member, (e) exposing said photoconductive member to erasing illumination through its base to create an electrostatic image of the first polarity defined by the first toner image and to cause charges of a second polarity to migrate to the vicinity of the surface of the photoconductive member under the first toner image, creating with said electrostatic image a field holding said toner to said photoconductive member, (f) applying a toner of a second polarity to said imaging member to create a second toner image overlying said first toner image, (g) exposing said imaging member to erasing illumination through its base, and (h) transferring said second toner image to a receiving sheet while retaining said first toner image on said imaging member.

2. The method according to claim 1 wherein said transfer step (h) includes the step of positioning a receiving sheet in face-to-face relation with said toner images and applying a transfer corona of a first polarity to the side of said receiving sheet opposite said photoconductive member.

3. The method according to claim 1 wherein the second toner applying step (f) is carried out by a magnetic brush having a sufficiently soft developer to prevent disturbing the first toner image.

4. The method according to claim 3 wherein said second toner applying step (f) is carried out by a magnetic brush having a rotating magnetic core and developer including hard magnetic carrier particles and insulating toner particles.

5. The method according to claim 1 wherein steps (e) through (h) are repeated a plurality of times to create a plurality of transferred toner images from a single exposure.

6. The method according to claim 5 including an additional step prior to each step (f) of gently cleaning said imaging member sufficiently to clean any residual toner from previous second toner images without substantially disturbing toner from the first toner image.

7. The process according to claim 6 wherein said cleaning step is carried out by a magnetic cleaning brush which includes a rotating magnetic core and magnetic cleaning particles.

8. The method according to claim 1 wherein the charge applied to the photoconductive member in step (a) is a negative charge, and the developer applied in step (c) is positively charged to create a first toner image corresponding to the unexposed portions of the electrostatic image formed in step (b).

9. The method according to claim 8 wherein the charge applied in step (d) is a negative charge, and the toner applied in step (f) is positively charged toner, and the transfer step (h) is carried out by applying a corona of a negative polarity to the rear of a transfer sheet brought into transfer relation with the second toner image.

10. The method according to claim 9 wherein the step of applying toner to create the second toner image includes applying toner that essentially the same as the toner used to create the first toner image in step (c).

11. The method according to claim 1 wherein the electrophotosensitive member is bipolar, and the toner applied in step (c) is charged to a polarity which is the same as the polarity of the electrostatic image created in step (b) to tone the discharged portions of said electrostatic image.

12. The method according to claim 1 including an additional step immediately prior to step (f) of applying a charge of a polarity the same as the charge applied in step (d) to said photoconductive member and illuminating said photoconductive member with erasing illumination from the front to dissipate charge on the photoconductive member that is not held on the first toner image.

13. A xeroprinting apparatus comprising:

a photoconductive imaging member, means for applying a charge to said imaging member of either a first or second polarity, means for imagewise exposing said imaging member to create an electrostatic image, means for applying toner of a second polarity to said imaging member to create a first toner image defined by said electrostatic image, means for applying a charge of a polarity opposite said second polarity to said imaging member, means for exposing said imaging member to an erase illumination through the base of the imaging member, means for applying toner of a second polarity to said imaging member to create a second toner image overlying said first toner image, means for applying a erase illumination through the base of said imaging member, means for transferring said second toner image to a receiving sheet without transferring said first toner image.

14. The apparatus according to claim 13 wherein said means for applying each of said toner images is a single development station, which development station includes a rotating magnetic core adapted to transport a developer of hard magnetic carrier particles and insulating toner into toning relationship with said imaging member.

15. The apparatus according to claim 13 further including a magnetic brush cleaning means for cleaning said first toner image of portions of said second toner image that remain on said imaging member after passing through said transfer means.

* * * * *